US009617696B1

(12) United States Patent
Burns et al.

(10) Patent No.: US 9,617,696 B1
(45) Date of Patent: Apr. 11, 2017

(54) LIGHTWEIGHT UNIVERSAL GAP CROSSING DEVICE AND METHOD OF USE

(71) Applicants: Killian Padraic Burns, Rockford, MI (US); Sungi Cho, Cooper City, FL (US); Steven Davidson, Byfield, MA (US); Max Arthur Saurwein, Kent, WA (US)

(72) Inventors: Killian Padraic Burns, Rockford, MI (US); Sungi Cho, Cooper City, FL (US); Steven Davidson, Byfield, MA (US); Max Arthur Saurwein, Kent, WA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 35 days.

(21) Appl. No.: 14/662,724

(22) Filed: Mar. 19, 2015

Related U.S. Application Data

(60) Provisional application No. 61/981,930, filed on Apr. 21, 2014.

(51) Int. Cl.
*E01D 15/12* (2006.01)
*E01D 21/06* (2006.01)

(52) U.S. Cl.
CPC ..... *E01D 15/124* (2013.01); *E01D 21/06* (2013.01)

(58) Field of Classification Search
CPC ..... E01D 15/00; E01D 15/127; E01D 15/22; E01D 15/124; E01D 21/065; E01D 21/06
USPC ..... 14/2.4, 2.5
See application file for complete search history.

(56) References Cited

U.S. PATENT DOCUMENTS 3,252,173 A * 5/1966 Robinsky ..... E01D 15/20 14/2.4
3,258,800 A * 7/1966 Robinsky ..... E01D 15/122 14/2.4
4,681,482 A * 7/1987 Arciszewski ..... E01C 19/522 14/2.4
4,722,108 A * 2/1988 Fredriksson ..... E01D 15/14 135/90
4,742,590 A * 5/1988 Glassman ..... E01D 15/14 14/2.4
5,904,025 A * 5/1999 Bass ..... E04G 23/0218 52/167.3
6,062,621 A * 5/2000 Zelazny ..... B63B 21/243 294/82.1
7,062,811 B2 * 6/2006 Fuessinger ..... E01D 15/133 14/13

(Continued)

*Primary Examiner* — Abigail A Risic
(74) *Attorney, Agent, or Firm* — John P. DiScala

(57) ABSTRACT

A crossing device aids in crossing from a near side to a far side of an obstacle. It comprises a lead assembly that is projected to the far side of the obstacle and that includes an anchor assembly and a pulley. The anchor assembly has a base, a launch tube that is secured to the base, a spike that is housed within the launch tube, and a propellant charge. The anchor assembly is anchored on the far side of the obstacle by remotely initiating the propellant charge. The explosion force drives the spike through the launch tube and the base, into a landing surface. A bridge is connected to the pulley and is pulled to span across the obstacle. The bridge, lead assembly, and anchor may be collected on the far side for additional uses.

16 Claims, 13 Drawing Sheets

(56) References Cited

U.S. PATENT DOCUMENTS

2008/0196182 A1* 8/2008 Gordon ..... E01D 15/122
14/2.5

* cited by examiner

LIGHTWEIGHT UNIVERSAL GAP CROSSING DEVICE AND METHOD OF USE

CROSS-REFERENCE TO RELATED APPLICATIONS

This application claims the benefit under 35 USC §119(e) of U.S. provisional patent application 61/981,930, filed on Apr. 21, 2014, which is herewith and which is hereby incorporated by reference in its entirety.

GOVERNMENTAL INTEREST

The invention described herein may be manufactured and used by, or for the Government of the United States for governmental purposes without the payment of any royalties thereon.

FIELD OF THE INVENTION

The present invention relates in general to the field of ground unit tactical movement. Specifically, this invention relates to a collapsible, foldable, and portable bridge (or ladder) for mobile use, to aid in crossing generally horizontal obstacles or gaps in urban and rural terrains, and in improving security and safety.

BACKGROUND OF THE INVENTION

Soldiers in a small group of four or more people who are operating in a combat environment, might find the need to remain mobile while carrying various loads, including their gear and weapons. It is foreseeable that, during their operation, the soldiers will encounter horizontal obstacles, such as canals, rooftop-to-rooftop, gaps, or minefields, that require a crossing device to assist them in avoiding the obstacles.

Crossing devices of various designs have been proposed. The following publications illustrate exemplary designs for crossing devices and associated auxiliaries. U.S. Pat. No. 6,062,621 generally describes a collapsible grappling hook that has a hook on the end. It is spring loaded and opens when thrown. When the grappling hook is thrown, it springs open and locks in place.

U.S. Pat. No. 7,062,811 generally describes a collapsible bridge that uses two triangle supports with two rails to provide the main structure over the gap. The rails are then overlaid with transverse girders that lock into place. The supports on the side and the girder rail system are collapsible. The girders are also stackable and the track is foldable.

U.S. Pat. No. 5,904,025 generally describes a method to reinforce a 90-degree intersection in a structural frame. Four triangular cross section beams come together to form a shear-resisting member of the frame structure. The intersection is formed by cutting and folding the three faces of each beam to increase surface area in contact with the other beam.

In general, the tactical advantages of quick gap crossing outlines two types of crossing: hasty and deliberate. There are nine subtasks possible to successfully cross a gap: Plan, Reconnoiter, Prepare, Deploy Assets, Prepare Assault Site, Secure Far Shore, Provide Crossing, Cross Force, and Reconstitute. These steps are detailed and explained. Communication standards are recorded for recon purposes, and methods of recon are also detailed. Command and control for offensive and retrograde operations are described.

This article applies to our work because our function is to perform hasty crossings. Our product will be involved in the steps from prepare to reconstitute. Also, this article outlines certain features to profile the gap to be crossed—such as condition of access/egress points, location and condition of existing crossing sites, reinforced obstacles, bank height, slope, and soil stability—which could influence the deployment of our device. Methods of reconnaissance may prove useful.

The report by Hornbeck, et al., "Trilateral Design and EST Code for Military Bridging and Gap-crossing Equipment," May 2005, available at http://www.dtic.mil/dtic/tr/fulltext/u2/a476390.pdf, generally describes the building code for the United States Military Bridging and Gap-Crossing Equipment. It discusses necessary material parameters, load parameters, size requirements, and safety parameters. It also discusses the United States Military system for rating bridges by Military Load Class. It discusses the necessary parameters of a military footbridge as well as commonly used materials.

Commercial ladders are also available, such as the three-way extension ladder found online at: http://www.ladder-guy.com/ladders/; and the Xtend and Climb telescoping ladder found online at: http://besttelescopingladder.com/xtend-climb-785p-aluminum-telescoping-ladder-type-i-professional-series.php.

While the foregoing conventional crossing devices provided a certain level of utility, there still remains an opportunity to provide a new gap crossing device that provides optimal features in term of portability, stackability, compactness, light weight, extension span, rapid deployment, reusability, durability, and ability to reliably support the weight of the soldiers, their gears, and their weapons (e.g., approximately 350 pounds). The new gap crossing device should be amenable for use in military and civilian applications.

SUMMARY OF THE INVENTION

The present invention addresses the foregoing concerns and presents a new collapsible, foldable, flexible, cost effective, portable gap crossing device, also referred to herein as a bridge or a ladder, for mobile use, to aid in crossing generally horizontal obstacles in urban and rural terrains and in improving security and safely. The gap crossing device is lightweight, small in volume, and is capable of supporting a load of approximately 350 pounds.

More specifically, the gap crossing device is sufficiently compact and light to be readily portable during small team dismounted movements. Due to the variable and rugged environments in which soldiers are traveling, the gap crossing device is designed to be durable. Also, due to the security concerns associated with crossing linear danger areas, the gap crossing device is further designed to be rapidly deployable to help reduce security concerns by making linear danger areas crossings as fast as possible.

In a preferred embodiment, the gap crossing device can have a span of approximately twenty feet. It is also able to cover a completely flat obstacle or slightly banked obstacle with a height variation of approximately ten feet. It weighs between approximately five pounds and twenty pounds, and occupies a volume between approximately one cubic foot and five cubic feet.

The gap crossing device uses a unique anchoring mechanism. Its method of use can be separated into three distinct phases: anchoring, employment, and redeployment. The anchoring phase relies on both near and far side placement. However, one of the benefits of the gap crossing device is it allows natural surroundings to be utilized. The near side anchoring can be based off mobile spikes emplaced by the user, or it can use natural anchoring points such as columns or trees. The far side emplacement can also be flexible. The gap crossing device can employ a hand-thrown system that will drive a far-side anchor point into the material. It uses a propellant to drive the anchoring point, namely a spike, into the target material.

The anchor spike will allow for penetration into a range of material in which the pullout strength will remain relatively consistent based on the penetration depth. The penetration depth increases in softer materials and decreases in harder materials. The harder materials will have higher pullout strength per unit length, allowing sufficient pullout strength regardless of material.

However, even the far side anchoring mechanism can be adaptable to the surroundings. For example, the anchoring mechanism can be manually emplaced. The far side anchoring mechanism uses a pulley effect based off a loop in the lead-wire connected to the anchor. Once the anchoring phase is complete, the employment phase commences.

The employment phase of the gap crossing device uses the flexible bridge design to carry the load across the gap. The bridge design uses parallel rungs placed equidistant apart against connecting steel wire in order the bear the point loads. It is pulled across a loop in the lead wire. It is then clamped against itself in order to create tension in the bridge.

In a preferred embodiment, the gap crossing device uses a standard ratchet strap on the near side. This allows the flexible body to become tensioned against both the near and far side anchors. The near side will utilize either a wide-based column support or employ spaced anchoring points. The far side of the flexible body uses modifiable horizontal spreaders that reduce twisting along the longitudinal axis in the latter half of the bridge. The tension in the bridge also minimizes lateral motion and allows unburdened personnel to cross on their feet rather than crawling. After the personnel have crossed, the bridge can either remain as a permanent fixture or redeploy.

The redeployment phase salvages the bulk of the gap crossing device and allows for the system to reengage at a different location, if necessary. The redeployment phase uses a clasp device that releases the tension in the flexible bridge. This allows the body to be pulled in and used again. The clasp uses a torsion spring to maintain the tension within the system. After all personnel have crossed, the torsion spring can be disengaged remotely from the far side releasing the gap crossing device. The anchor emplacements will be consumable but the bulk of the weight of the gap crossing device can be used in future missions.

BRIEF DESCRIPTION OF THE DRAWINGS

The accompanying drawings, which are incorporated in, and constitute part of this specification, illustrate embodiments of the invention and together with the description, serve to explain the principles of the invention. The embodiments illustrated herein are presently preferred, it being understood, however, that the present invention is not limited to the precise arrangements and instrumentalities shown, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1:
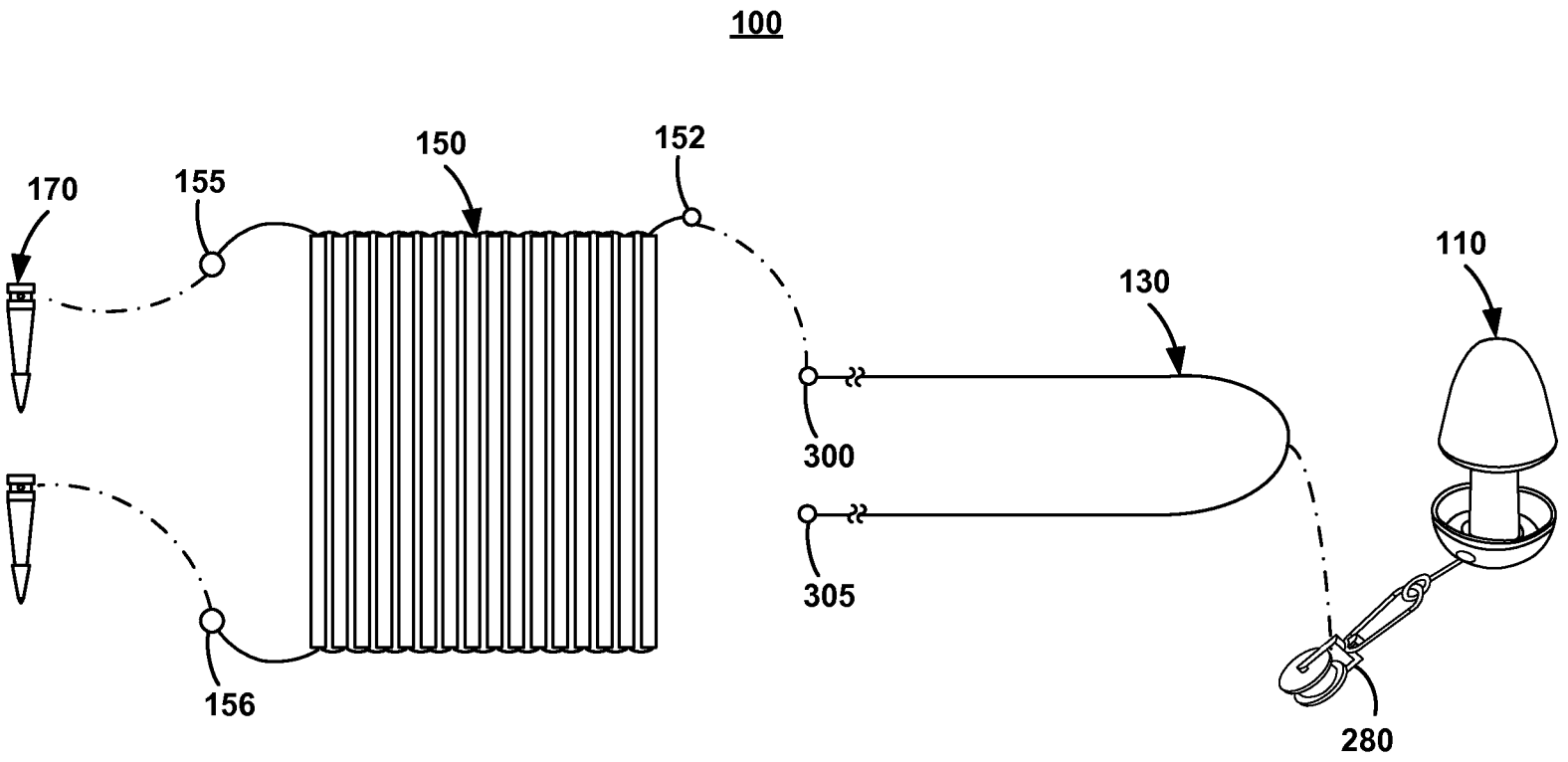
FIG. 1 is an exploded view of a gap crossing device according to a preferred embodiment of the present invention, illustrating its four main components: a lead assembly, a cable, a collapsible bridge, and a near side anchor assembly.

With reference to FIG. 1, it illustrates a new gap crossing device 100 according to a preferred embodiment of the present invention. The gap crossing device 100 presents numerous features and advantages, amongst which are the following: portability, stackability, compactness, light weight, long extension span, rapid deployment, reusability, durability, ability to reliably support the weight of the soldiers, their gears, and their weapons (e.g., ability to support a load of approximately 350 pounds). The new gap crossing device 100 is amenable for use in military and civilian applications, such as law enforcement, fire departments, emergency relief agencies, humanitarian aid and rescue operations, back country hiking and mountaineering, and other similar activities.

The gap crossing device 100 generally includes four main components: a lead assembly 110, a cable 130, a bridge (also referred to herein as ladder) 150, and a nearside anchor assembly 170.

Figure 2A:
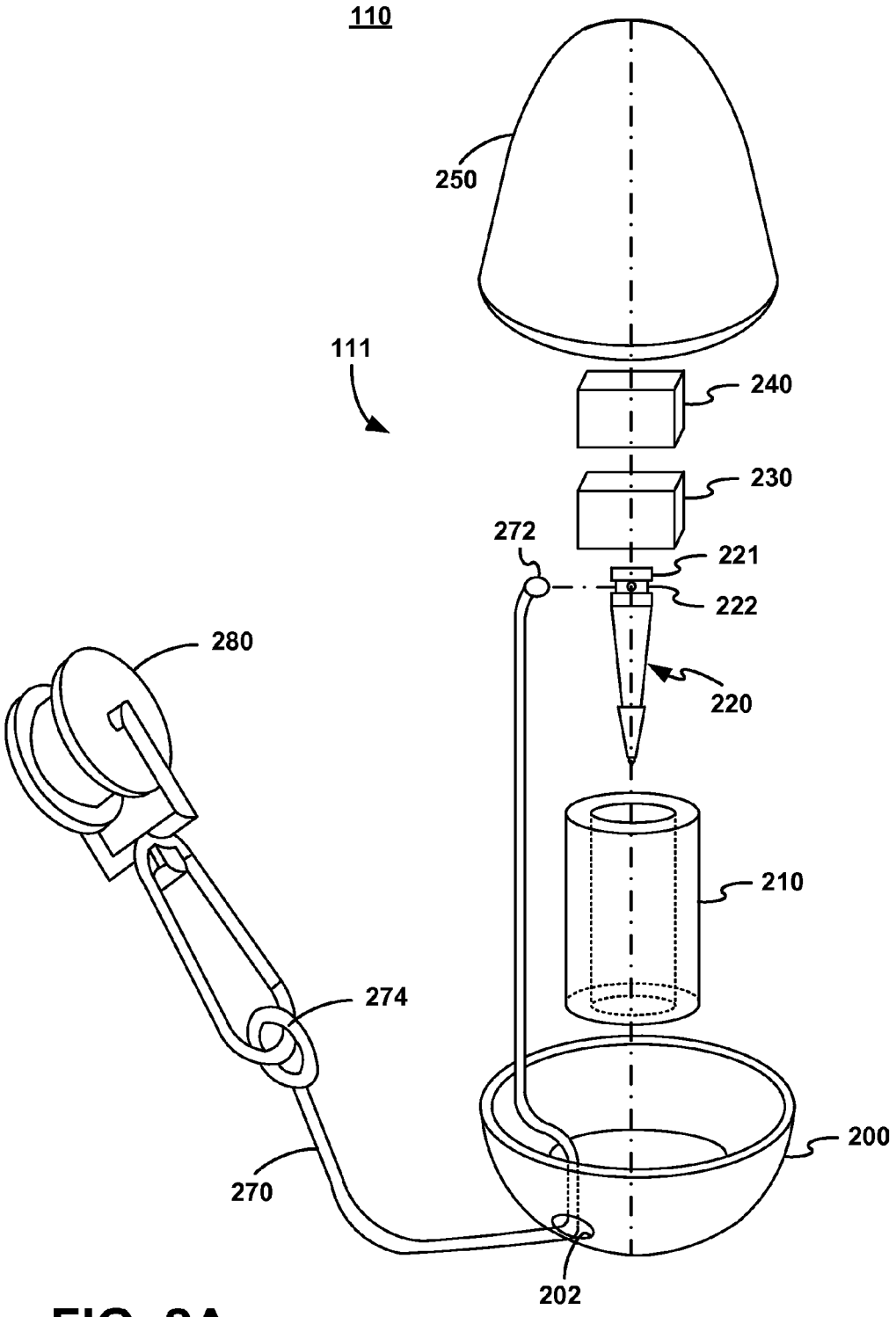
FIG. 2A is an exploded view of the lead assembly of FIG. 1 that includes a far side anchor assembly, a tether cable, and a pulley.
Figure 2B:
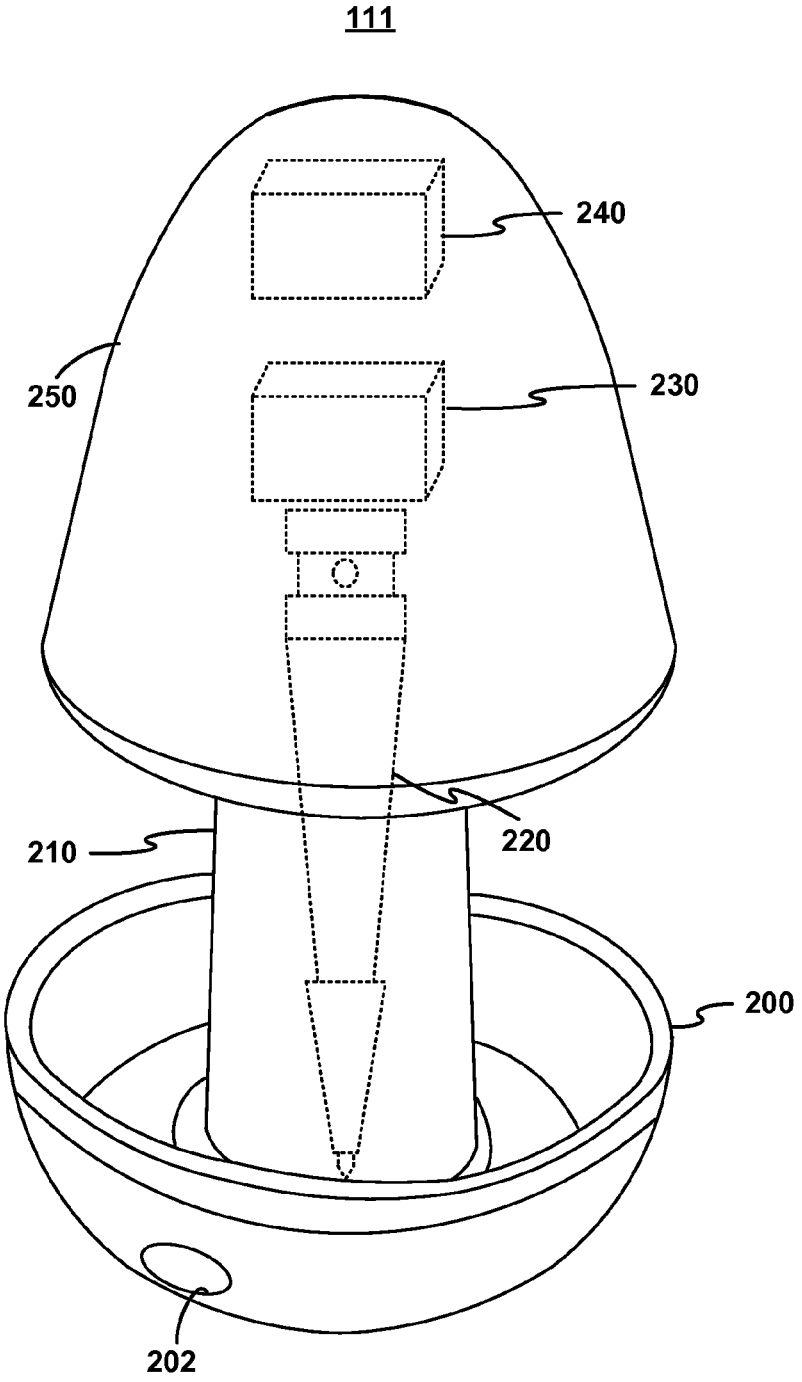
FIG. 2B is an assembled view of the far side anchor assembly of FIG. 2A, showing the placement of the various components therewithin.

With further reference to FIGS. 2A and 2B, the lead assembly 110 is the component that is thrown as a projectile from a near side of an obstacle 400, such as a river (FIG. 4), to the far side of the obstacle 400. The lead assembly 110 generally includes a far side anchor assembly 111, a wire pulley tether 270, and a pulley 280. The far side anchor assembly 111 includes a steel base 200, an aluminum topper (launch tube) 210, a far side spike 220, a pack of propellant 230, a remote actuation device 240, and a plastic cap 250.

Upon assembly, the plastic cap 250 is glued to the aluminum topper 210 in order to allow the propellant pack 230 (e.g., packed powder charge) to eject the plastic cap 250 that cannot withstand the force of the blast, while introducing the far side spike (or anchor) 220 into the far-side surface. The propellant-based spike 220 uses geometry and a low center of gravity to land upright when thrown. The propellant is then actuated using, for example, command wire actuation to cause the far side spike 220 to be driven into the ground. The far side spike 220 penetrates multiple different materials from wood to soil, and can hold, for example, a load of approximately 350 pounds. Through testing, it has been determined that the pullout force required to remove the far side spike 220 from wood exceeds the force required to hold the flexible bridge 150 while being crossed, validating the design.

The aluminum topper 210 screws into place in the steel base 200 by means of one or more screws (not shown). The purpose of the heavy steel base 200 is to orient and land the far side anchor assembly 111 in the proper position when the gap crossing device 100, including the pulley 280, is thrown to the far side of the obstacle 400.

The propellant pack 230 is stored between the plastic cap 250 and a head 221 of the far side spike 220, providing an upward force on the cap 250 and a downward force on the far side spike 220 when blown. Due to restrictions upon availability of the propellants, gunpowder is a viable choice for the solid propellant pack 230. A preferred propellant is a smokeless shotgun powder due to its rapid burn rate.

The remote actuation device 240 may be housed, for example, within an internal chamber of the cap 250. The remote actuation device 240 enables a user (e.g., a soldier) to remotely initiate the propellant pack 230, from the near side of the obstacle 400.

The wire pulley tether 270 is secured at one end to a neck 222 of the far side spike 220. The wire pulley tether 270 is crimped to make a loop 272 that is smaller than the head 221 of the for side spike 220, in order to be tightly secured to its neck 222. The wire pulley tether 270 extends through an opening 202 formed in the bottom of the steel base 200, to connect to the pulley 280. The pulley 280 provides connection to the cable 130. An alternative to the use of the pulley 280 is a plain loop 274 at the terminal end of the wire tether 270.

Figure 3:
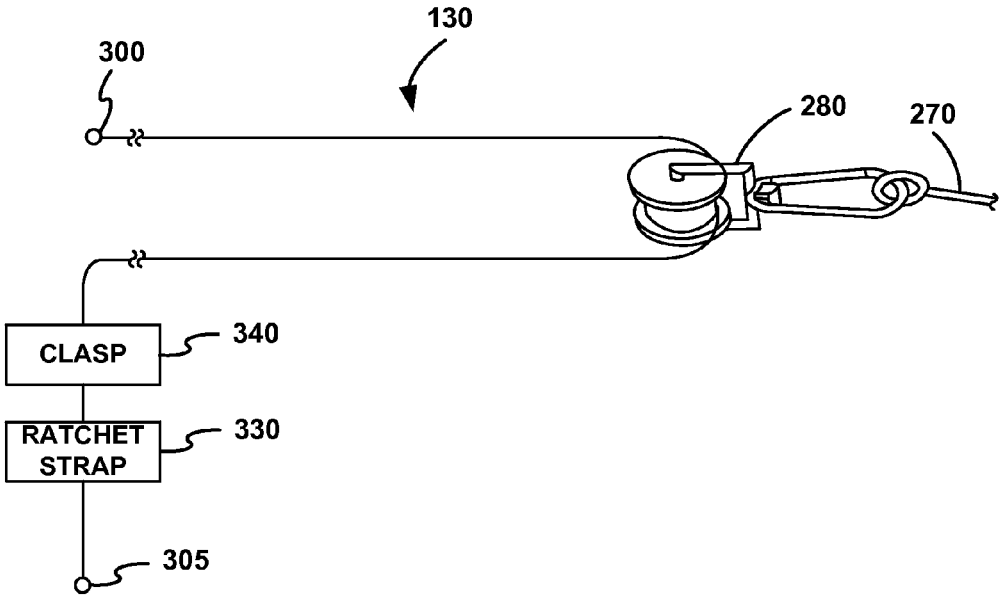
FIG. 3 is view of the cable of FIG. 1, shown secured to a tensioning ratchet strap and a redeployment clasp that form part of the near side anchor assembly.
Figure 4:
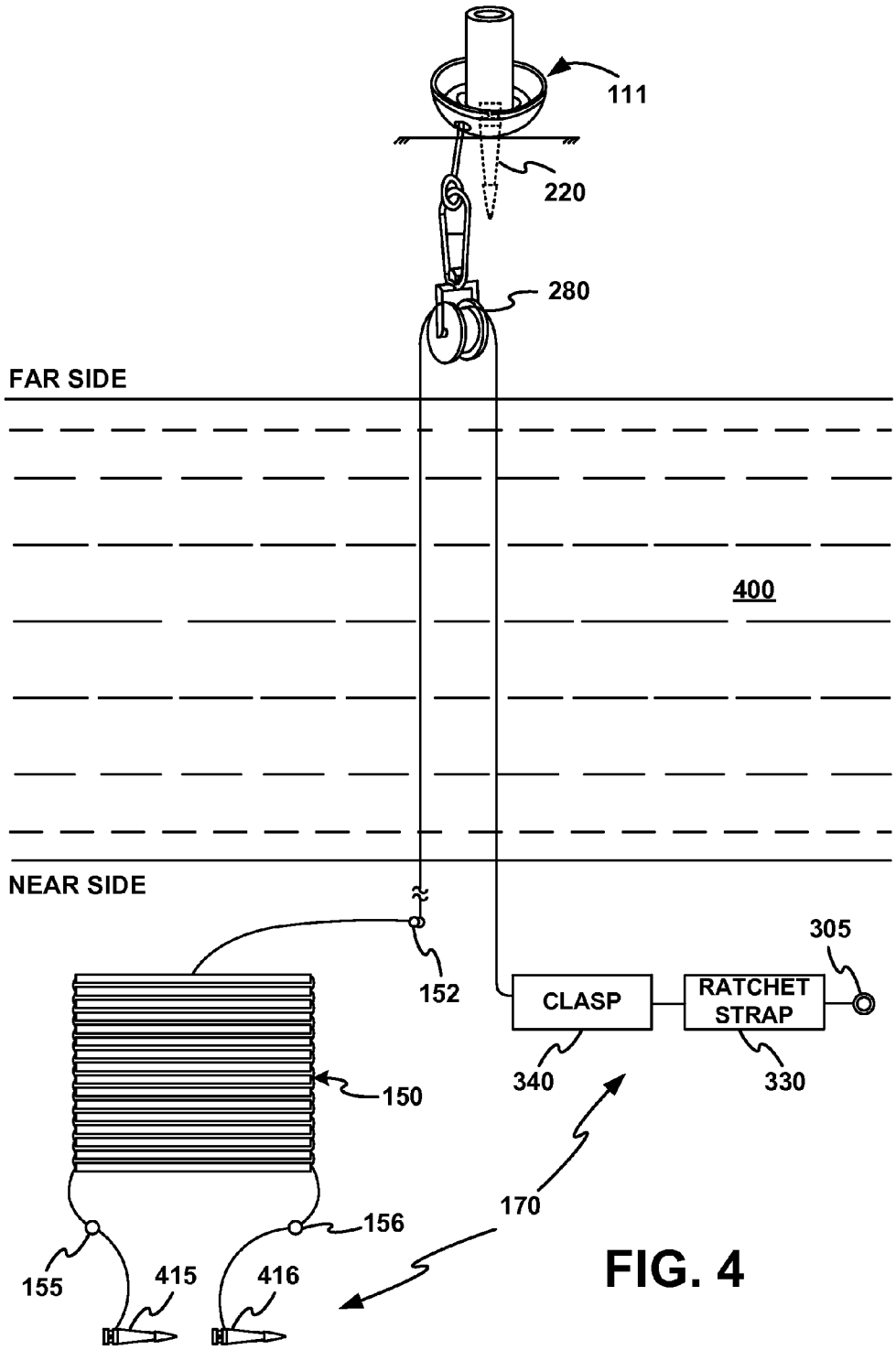
FIG. 4 is a view of the gap crossing device shown during an anchoring stage.

As further illustrated in FIGS. 3 and 4, the cable 130 connects the lead assembly 110 to the bridge 150. The bridge 150 is initially on the near side of the obstacle 400, and will need to be extended toward the lead assembly 110 that was previously anchored on the far side of the obstacle 400, in order to breach the gap between the near side and the far side.

In use, the cable 130 is looped through the pulley 280 halfway. Once the lead assembly 110, including the pulley 280, is thrown to the far side of the obstacle 400, the bridge end 300 and the tie end 305 of the cable 130 remain on the near side, completing the anchoring phase as illustrated in FIG. 4.

Figure 5:
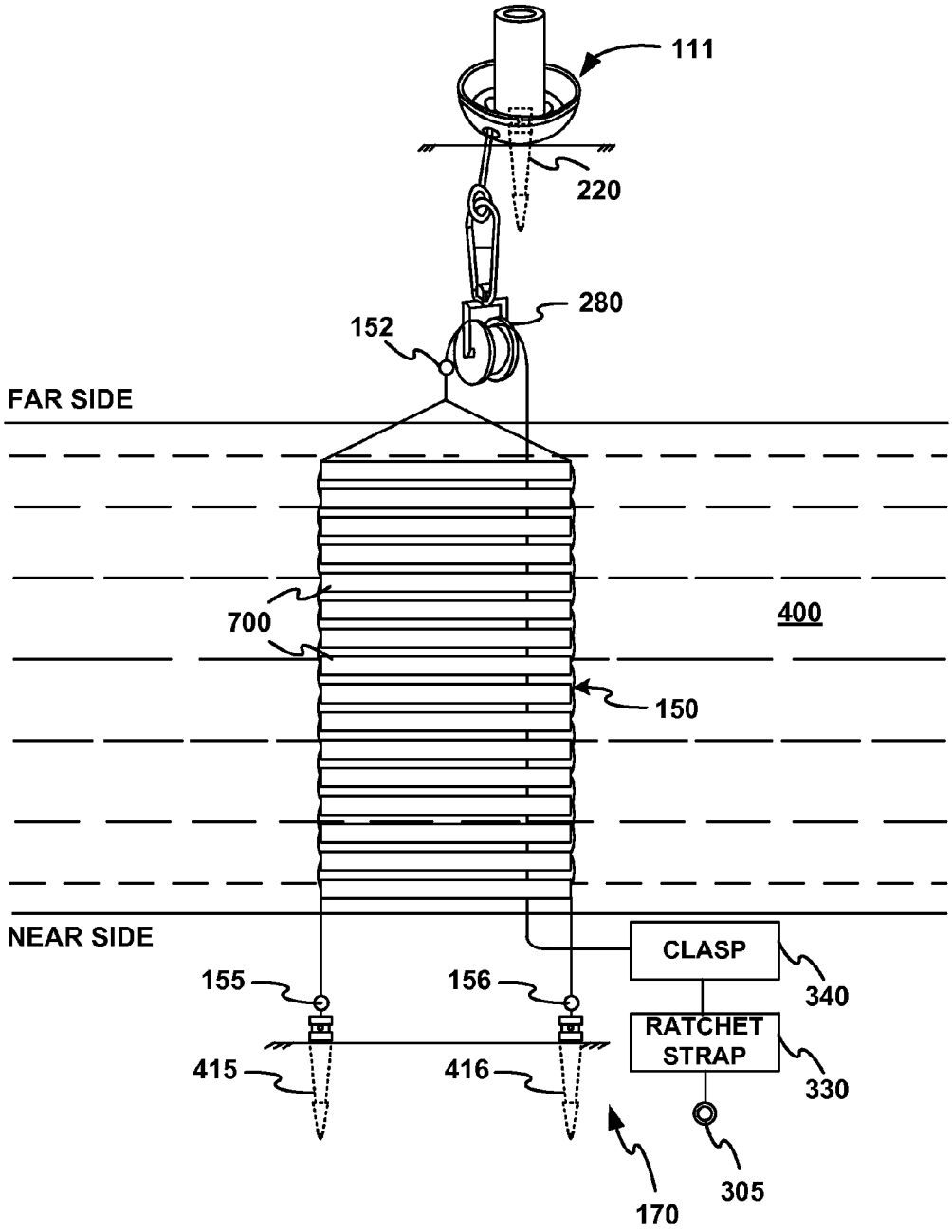
FIG. 5 is a view of the gap crossing device shown during an employment stage.

With further reference to FIG. 5, the employment phase starts with the user applying a pulling force to one of the cable ends, such as the tie end 305, which in turn pulls the bridge end 300 of the cable 130 toward the far side. Since the bridge end 300 of the cable 130 is tied to one end 152 (FIG. 1) of the bridge 150, the pulling force also drags the bridge 150 toward the far side. Once the bridge 150 is extended to the desired length across the obstacle (or gap) 400, the tie end 305 of the cable 130 is tied down on the near side for support.

One or more near side spikes 415, 416, which form part of the near side anchor assembly 170, are then stabilized in the near side surface, ground, or available elements found in the environment (e.g., a tree trunk). In a preferred embodiment, the near side spikes 415, 416 are stabilized by applying a downward force to the spikes 415, 416, which secures the near side end 155 (FIG. 1) of the bridge 130. The near side spikes 415, 416 are able to hold the bridge 150 in tension while a load is applied at mid-span, normal to the walking surface.

With reference to FIGS. 3, 4, 5, and 13, the near side anchor assembly 170 may further include a commercially available tensioning mechanism. One proposed design incorporates a tensioning ratchet strap 330 and a redeployment clasp 340, which attach to the end of the steel wire 1320 (FIG. 13) that spans the bridge 1300 using loops in the wire 1320. The tensioning mechanism can be attached at any rung 700 of the bridge 1300 before use or during use if necessary, and then either detached after use or stored, still connected to the bridge 1300. The bridge 1300 tends to sag if not fully tensioned. Proper tension in the wire 1320 allows for a more easily traversable bridge 1300.

During the employment phase of FIG. 5, the tensioning ratchet strap 330, and the redeployment clasp 340 remain at the near side of the obstacle 400. It should also be noted that the deployed bridge 150 could be locked at any desired length, depending on the width of the obstacle 440.

Figure 6:
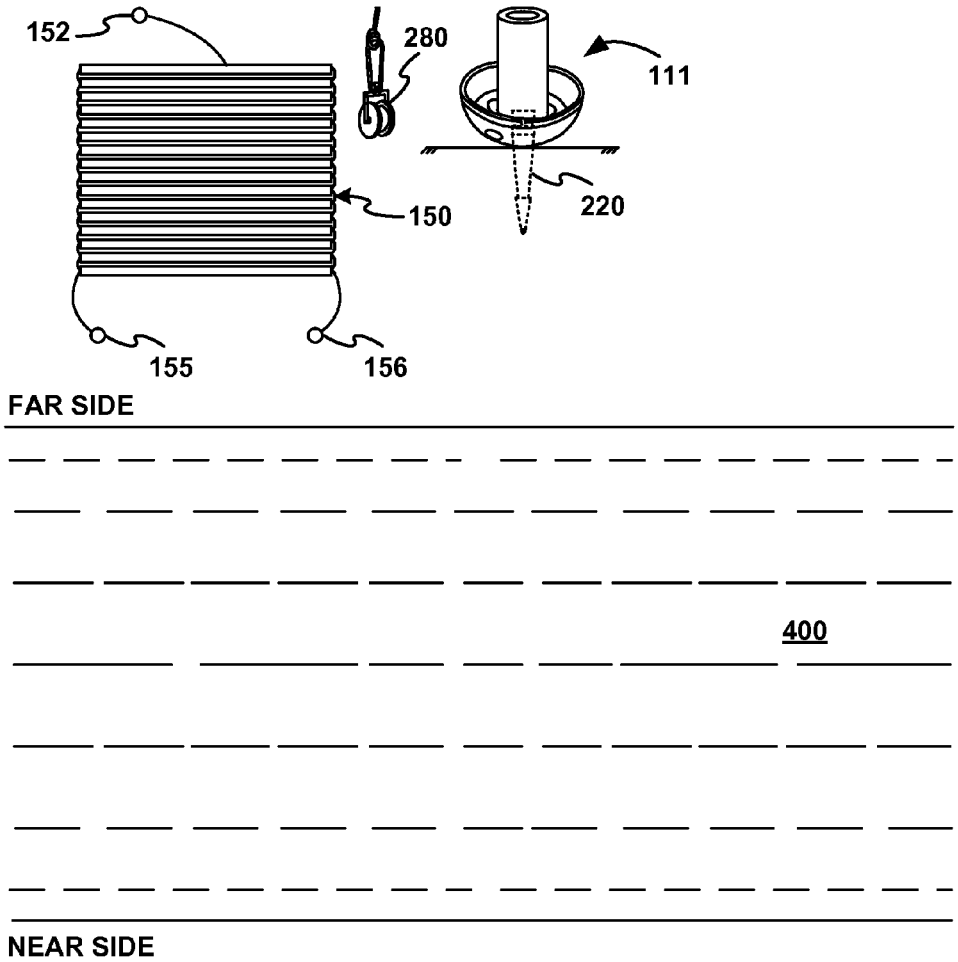
FIG. 6 is a view of the gap crossing device shown during a redeployment stage.
Figure 6:
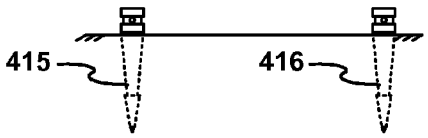

The redeployment phase is illustrated in FIG. 6. The tensioning ratchet strap 330 is used to reduce lateral instability and cable sage. The redeployment clasp 340 is used to release the tension on the cable 130 and the bridge 150, in order to enable the complete redeployment of the bridge 150 from the far side of the obstacle 400, to the near side. The redeployment clasp 340 can be remotely activated from the near side of the obstacle 400.

Figure 7:
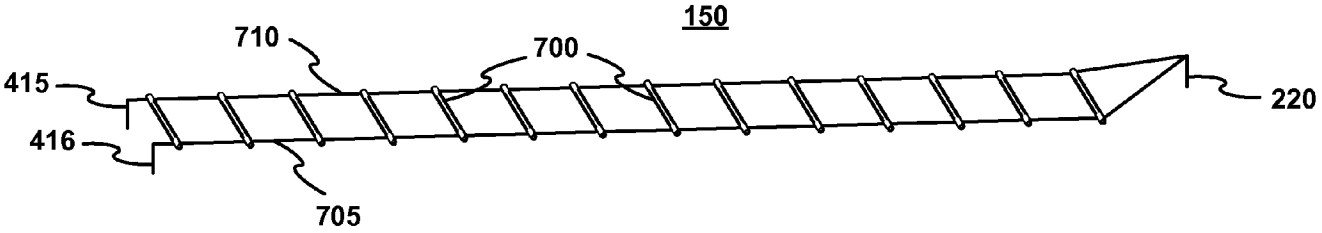
FIG. 7 is a view of the bridge shown in a fully deployed condition.
Figure 9:
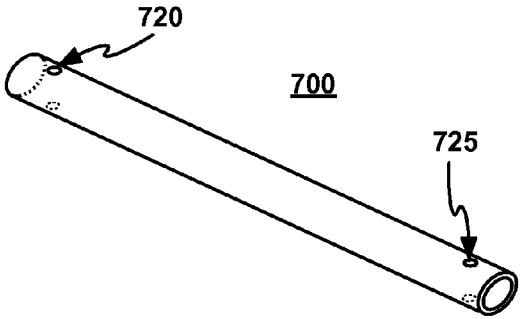
FIG. 9 is a side view of one of the rungs of the bridge of FIGS. 7 and 8.
Figure 8:
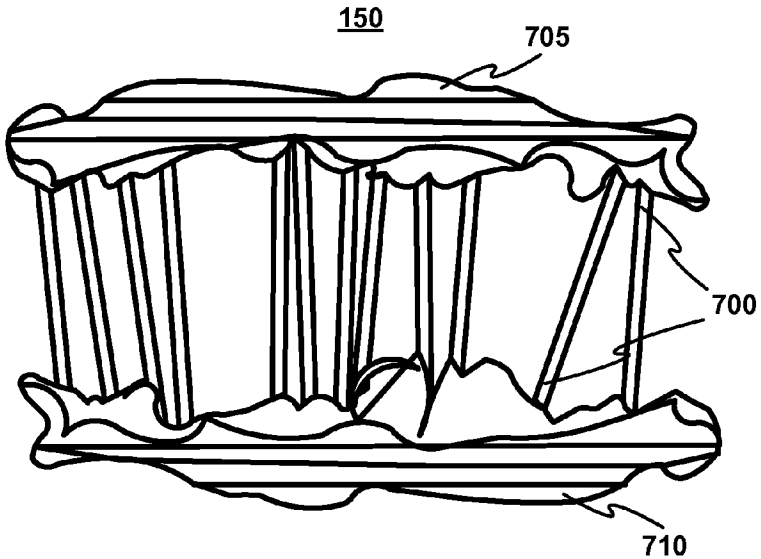
FIG. 8 is a view of the bridge shown in a collapsed condition.

With further reference to FIGS. 7, 8, 9, the bridge 150 is constructed of a plurality of strong rungs 700 that support the intended loads, and of two cable sides 705, 710 that provide stability to the rungs 700. In one design, the flexible bridge 150 spans a horizontal obstacle of approximately 20 feet. The flexible bridge 150 is approximately 25 feet long and weighs approximately 14 pounds. It is primarily composed of two ⅛th-inch wire side ropes 705, 710 and twenty aluminum rings 700.

Each rung 700 is preferably hollow and cylindrically shaped, with each end including two diametrically opposed holes 720, 725 for securing the rungs to the side ropes (or cables) 705, 710. The side ropes 705, 710 are preferably made of steel.

The near side of the bridge 150 is secured to a ratchet strap 330 for tensioning the bridge 150, and a clasp 340 for redeployment. The far side of the bridge 150 can utilize a trapezoidally shaped aluminum pipe and wire rope to stabilize the bridge 150 and counteract twist.

As it has become clear from the foregoing description, one of the main benefits of the gap crossing device 100 is that the hand thrown lead assembly 110 replaces the need for a soldier to leave the security of the rest of the unit and expose himself or herself to hazards while navigating the obstacle 400 unaided, to secure the far side. Additionally, the gap crossing device 100 does not rely on a tree or other environmental structures to secure the bridge 150 to the far side of the obstacle 400, making it usable in versatile environments, not merely wooded areas.

Figure 10A:
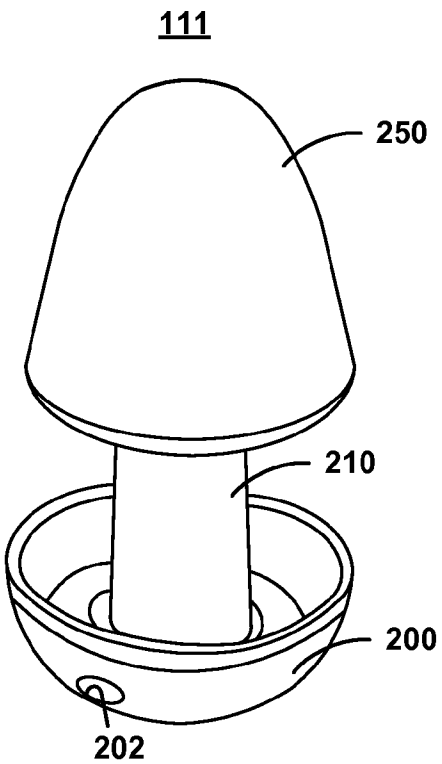
FIG. 10A is a perspective view of a first anchor assembly that forms part of the lead assembly of FIG. 2, shown provided with a cap.
Figure 10B:
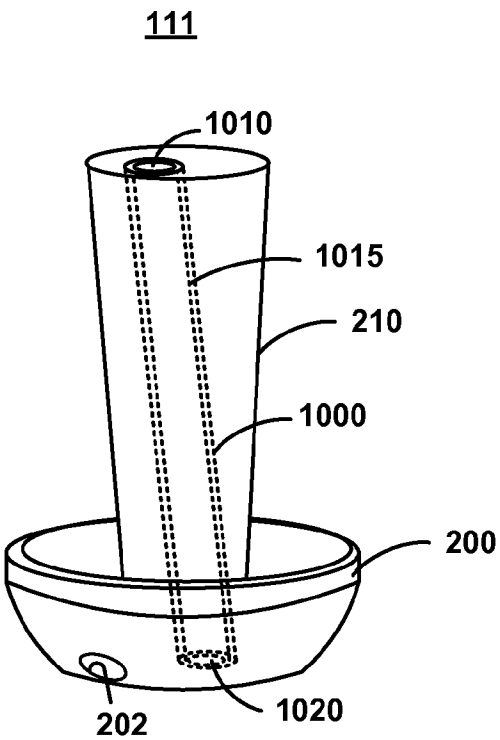
FIG. 10B is a perspective view of the anchor assembly of FIG. 10A, with the cap removed.

FIGS. 10A and 10B are representations of the anchor assembly 111 according to a first embodiment of the present invention. As descried earlier, the anchor assembly 111 generally includes the base 200, the topper 210, and the cap 250. In this embodiment, the cap 250 provides a mushroom cover along the exposed length of the topper 210, over the hollow base 200. This allows the center of gravity of the anchor assembly 111 a greater vertical moment with respect to the side of the base 200 when laid horizontally.

The topper 210 includes a hollow launch chamber 1000 that extends along the length of the topper 210, to provide a launch path to the far side spike 220. The launch chamber 1000 is open at it upper end 1010 and its bottom end 1020. The upper end 1010 allows the entry of the far side spike 220 to the launch chamber 1000, while the bottom end 1020 enables its exit through an opening 1070 (FIG. 10E) at the bottom of the base 200.

While the topper 210 has been described earlier as being composed of aluminum, it should be understood that the topper 210 might be made of a different material, including but not limited to high-strength plastic. Alternatively, the topper 210 might be made of light weight material, with the launch chamber diameter accommodating a metallic conduit 1015.

While the launch chamber 1000 can be axially disposed relative to the topper (or launch tube) 210, FIG. 10B illustrates an alternative embodiment wherein the launch chamber 1000 is disposed at an angle relative to the central axis of the topper 210. In this alternative design, the far side spike 220 will travel along the slanted launch chamber 1000 to reach the far side surface at an angle, allowing for a higher pullout force. A higher pullout force allows more tension in the system, and therefore more weight to be supported.

The design of the anchor assembly 111 uses the moment and center of gravity principles to enable the anchor assembly 111 to land in the desired vertical (or slanted) position, so that far side spike 220 is propelled with optimal penetration force. The difference in densities between the parts of the anchor assembly 111, and the dimensions of the steel base 200, shift its center of gravity very close to the bottom of the base 200, allowing the anchor assembly 111 to upright itself.

Figure 10C:
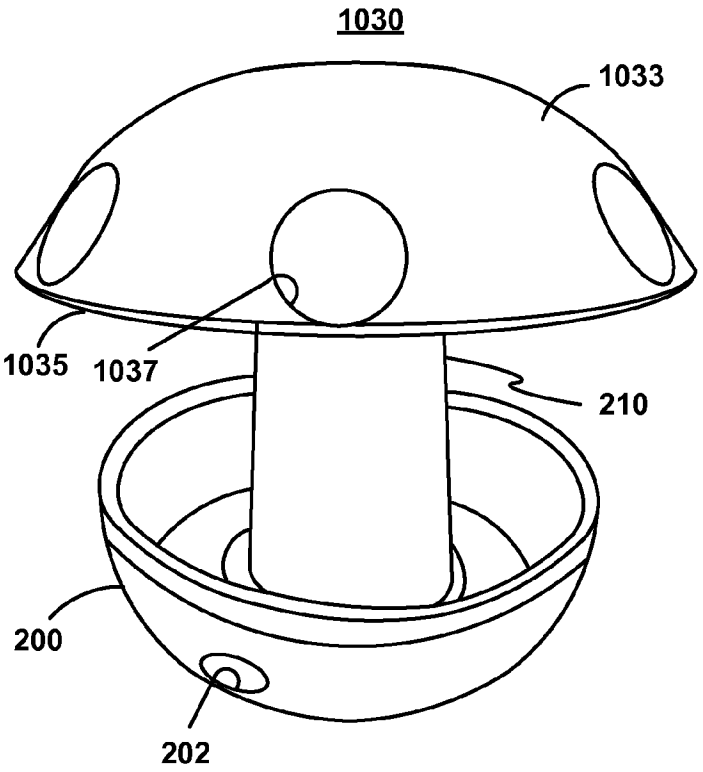
FIG. 10C is a perspective view of a second anchor assembly shown provided with a cap.
Figure 10D:
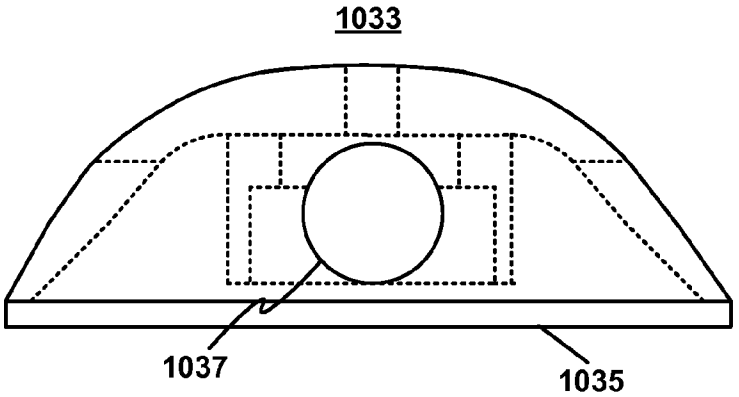
FIG. 10D is a side view of the cap of the second anchor assembly of FIG. 100.
Figure 10E:
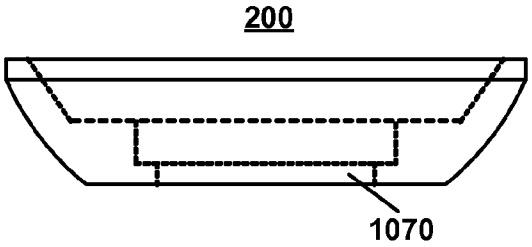
FIG. 10E is a side view of a base that forms part of the second anchor assembly of FIG. 10C.

FIGS. 10C, 10D, 10E illustrate a second anchor assembly 1030 shown provided with a new cap 1033. In this design, the base 1035 of the cap 1030 is widened and the mass of the cap 1033 is reduced by perforating the cap 1033 with at least one circular cutout 1037. This allows a lesser counter moment on the base 200, helping in restoring moment to the vertical position. The circular cutouts 1037 are designed to reduce the weight of the cap 1033, lowering the center of gravity of the anchor assembly 1030 and allowing the anchor assembly 1030 to land upright. The dotted lines mark the grooves on the inside of the base 200 allow the shaft 210 to screw into the base 200 and the cap 1030. The opening 202 in the base 200 allows a fuse to run through the base 200 for detonation.

Considering now the various designs of the far side spike with respect to FIGS. 11A, 118, 11C, 11D, FIG. 11A is a side view of a first preferred embodiment of the far side anchor or spike 220 that forms part of the anchor assembly 111. The far side spike 220 is preferably made of tungsten, though other suitable material may alternatively be used.

The far side spike 220 generally includes the head 221, the neck 222, and a body 1100. The body 1100 is formed of a forward (or nose) section 1110 and a main section 1115. Both sections 1110, 1115 are generally conically shaped, so the diameter change at the interface between these two sections 1110, 1115 creates a lip 1111. The lip 1111 has a sufficient circumferential surface area to increase the pressure surface area with the penetrated ground (or surface), in order to increase the pullout force.

The neck 222 of the far side spike 220 includes a through opening 1118 to engage the tether cable loop 272 (FIG. 1). The largest diameter of the far end spike 220 fits precisely within the launch tube in the topper 210. The openings and surfaces of the far end spike 220 are cut or drilled to within ten thousandths of an inch.

Figure 11A:
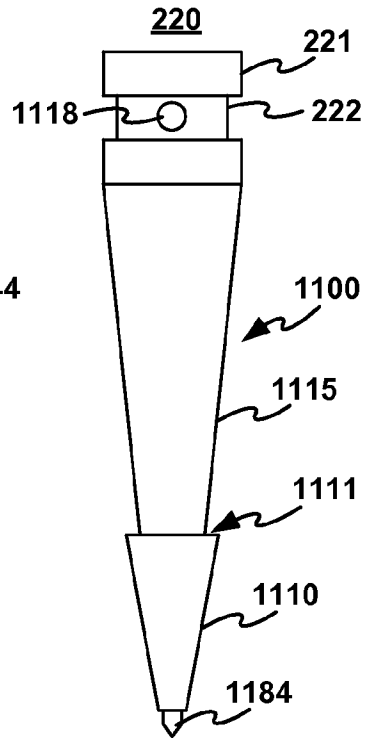
FIG. 11A is a side view of a first preferred embodiment of a far side anchor or spike that forms part of the gap crossing device of FIG. 1.
Figure 11B:
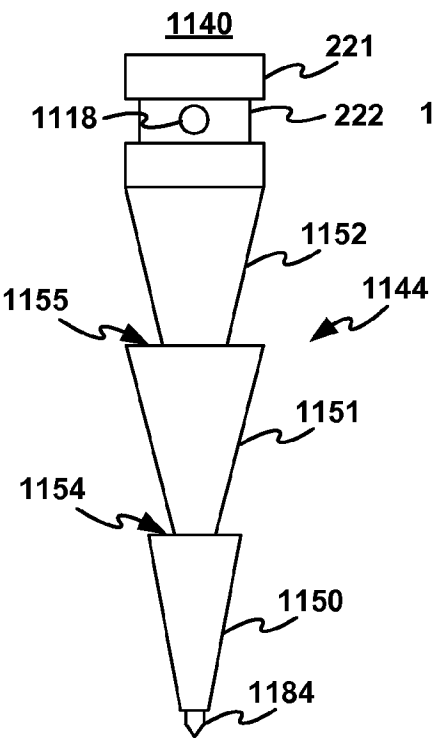
FIG. 11B is a side view of a second preferred embodiment of the far side anchor or spike that forms part of the gap crossing device of FIG. 1.

FIG. 11B illustrates yet another far side spike 1140 according to the present invention. The far side spike 1140 is generally similar in design and construction to the far side spike 220, with the exception that the far side spike 1140 includes a plurality of conical body sections, for example three conical body sections 1150, 1151, 1152. The present invention is not limited to the illustrated three conical body sections 1150, 1151, 1152, and another number of body sections is contemplated within the scope of the present invention. The three conical body sections 1150, 1151, 1152 have different conical dimensions so that their intersection surfaces form a plurality of lips 1154, 1155 that further increase the pressure surface area with the penetrated ground as well as the pullout force.

Figure 11C:
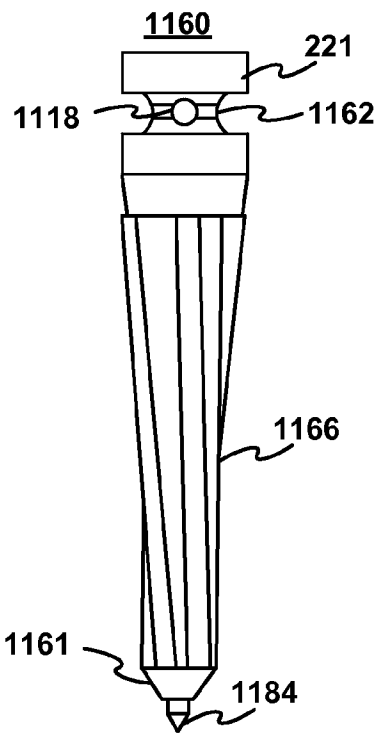
FIG. 11C is a side view of a third preferred embodiment of the far side anchor or spike that forms part of the gap crossing device of FIG. 1.

FIG. 11C illustrates still another for side spike 1160 according to the present invention. The far side spike 1160 includes the head 221, a neck 1062, a nose section 1161, and a main body 1166. The neck 1162 is not cylindrically straight, as illustrated in FIGS. 11A and 11B. Rather, the neck 1162 has an arcuate outer surface in order to allow for penetration into softer materials such as wood.

The main body (or shaft) 1166 has an X-shaped cross-sectional area in order to increase the surface area contacting the surface material, therefore increasing friction holding the spike in place. A slight twist is added to the cross section to allow for an increase in pullout. The nose 1161 allows for a sharp surface area, which allows for increased fluid pressure to increase the penetration, velocity and pullout strength.

Figure 11D:
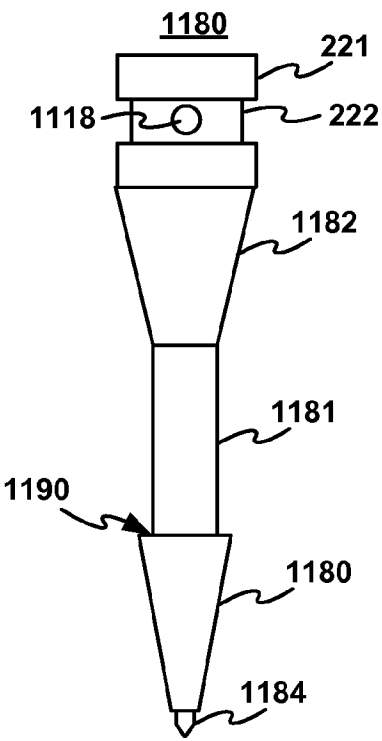
FIG. 11D is a side view of a fourth preferred embodiment of the far side anchor or spike that forms part of the gap crossing device of FIG. 1.

FIG. 11D illustrates yet another far side spike 1180 according to the present invention. The far side spike 1180 includes the head 221, the neck 222, a nose 1180, an intermediate shaft 1181, and a conical body section 1182. The conical body section 1182 extends from the neck 1118 and decreases in diameter to match the diameter of the intermediate shaft 1181 that has a smaller diameter than the conical body section 1182. When manufactured, the intermediate shaft 1181 is extruded suddenly from the conical body section 1182, to increase the pullout strength of the material, with the sharp angle of the extruded cut providing more resistance during pullout. The nose 1180 is conical and terminates in an ogive shaped tip 1184. A lip 1190 is formed by the interface of the intermediate shaft 1181 and the nose 1180 to increase the required pullout force.

Figure 12A:
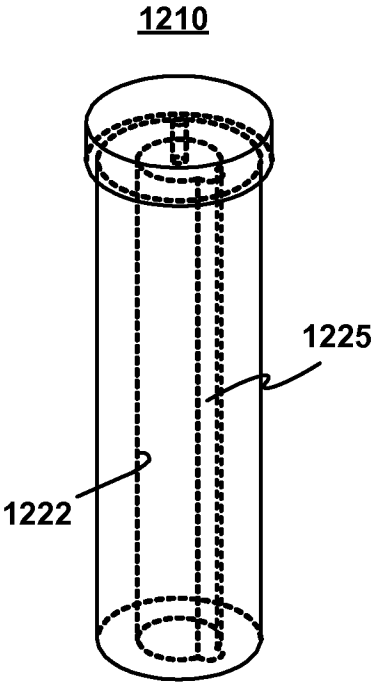
FIG. 12A is a perspective view of a topper that forms part of the anchor assembly of FIG. 100.
Figure 12B:
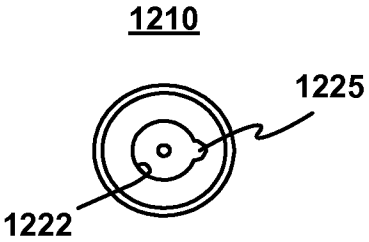
FIG. 12B is a top view of the topper of FIG. 12A.
Figure 12C:
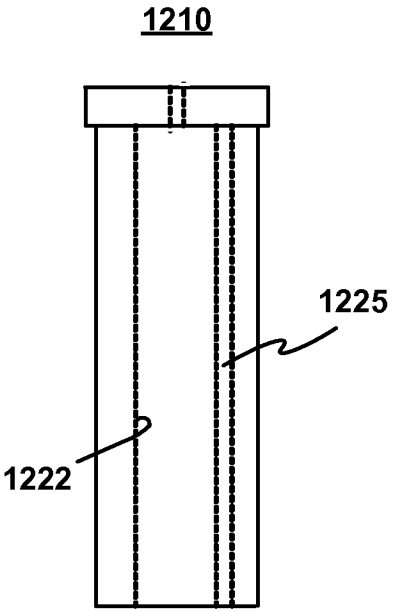
FIG. 12C is a side view of the topper of FIGS. 12A and 12B.

With reference to FIGS. 12A, 12B, 12C, they illustrate a topper (or launch tube) 1210 that may be used in the anchor assemblies 111 and 1030 of FIG. 10A, 10B, 10C. The topper 1210 is modified to accommodate the tether cable 270 to the far end spike 2210 this end, the topper 1210 is formed with a hollow launch chamber 1222 that is generally cylindrically shaped with a substantially circular cross-section. In this specific embodiment, the hollow launch chamber 1222 has been modified to include a smaller channel 1225 along its length, through which the tether cable 270 is run. The main function of the channel 1225 is to allow room for the tether cable 270, which is attached to the spike.

A ballistics test analysis of the gap crossing device 100 was undertaken, including testing at ranges that provided data used to determine the ballistics characteristics of the propellant drive far end spike 220. At these ranges, the spike penetration thickness, spike penetration angle, free recoil displacement, charge size, and muzzle velocity were measured through different means.

The Demarre equation was used to determine impact velocity. The standard form of the Demarre equation is utilized to predict armor penetration thickness, as follows:

$$V_{impact} = \frac{\sqrt{\frac{2cd_i^3}{m_p}}}{10^6}$$

The Demarre coefficient is used to relate hardness of materials in order to use this equation. The range of the Demarre coefficients are generally not found for materials other than steel and armor materials so an estimation of the Demarre coefficient was made. The value of steel was reduced by an order of magnitude of 10 resulting in a value of $1*10^6$. The impact velocity was then check with high speed camera footage in order to determine validity of the measurement. The estimated and measured values varied 10 ft/s and a percent difference of 6.67%.

Newton's second law was used to determine the pressure in the barrel, as follows:

$$P_c = V_o^2 \frac{m_p}{2A_b}$$

$$S_y = \frac{P_c\sqrt{3}}{10\text{^}6}$$

Newton's second law was also used to determine the maximum barrel stress along the radial and longitudinal axes.

$$\sigma_t = P_c \frac{\left(\frac{W^2+1}{W^2-1}\right)}{10^6}$$

$$\sigma_r = \frac{-P_c}{10^6}$$

Free recoil analysis was used to determine recoil velocity and maximum spike velocity.

$$\text{Free Recoil Velocity: } V_{recoil} = \frac{((W_p + V_o) + (W_c * V_c))}{W_r}$$

$$\text{Spike Maximum Velocity: } V_{max} = \frac{V_{recoil}}{\frac{((0.5 * m_c) + m_p)}{m_r}}$$

Based on this and other analyses, the gap crossing device 100 is provided with a four-part construction, as described earlier. The heavier base 200 will be constructed of 1045 steel. The topper 220 will be constructed of aluminum, with a plastic cap 250 that is made for example with a 3D printer. The cap 250 is retained in place with screw threads and designed to detach upon detonation. The topper 210 may be made of plastic material and houses a steel barrel or conduit 1015 (FIG. 10B). The anchor assembly 111 attaches to a pulley or a pulley system 280. In turn, the pulley 280 is connected to the bridge 150 by means of a strong steel leader or tether cable 270 that loops around the far end spike 220. Prior to the initiation of the propellant pack 230, the far end spike 220 is house within the launch chamber 1222.

The far end spike 220 can be designed to penetrate concrete by constructing it of 1045 steel. The rungs 700 stretching across the bridge 150 are preferably constructed of lightweight PVC, a composite, or aluminum, depending on testing performance.

The anchor assembly 111, including the propellant pack 230 are capable of creating a spike muzzle velocity that is sufficient to penetrate concrete. Achieving an adequate penetrative depth is imperative for ensuring a reliable anchor support that is capable of bearing the required minimum 350 pounds force. In order to accomplish this, the powder charge of the propellant pack 230 is capable of producing a 150 m/s muzzle velocity, with the assumption that the compressive strength of concrete is 30 MPa, which is a relatively high magnitude for typical man-made structures.

First, the energy of the far end spike 220, immediately following the actuation was calculated using the following equation:

$$E = \frac{1}{2}mv^2$$

where m is the mass of the far end spike 220 and v is its velocity. With a mass of 0.15 kilograms, the spike can obtain 1244.64 foot-pounds of energy. Using this value for the spike energy, the penetration depth in concrete was solved using the equation:

$$\frac{e}{d} = m\left(\frac{Ecp}{fcd^3}\right) + b$$

where m and b are dimensionless values derived from a linear equation. Ecp is the spike energy, fc is the compressive strength of concrete, and d is the spike diameter. Assuming CRH=3.0, then m=0.0941 and b=4.129. This equation asserts that a 1045CR steel spike can achieve a depth penetration of 5.28 inches, which is enough to bear the load and allow adequate tension of the entire bridging system. This depth ensures that as long as the reactionary forces do not cause the anchor assembly 111 to be ejected upward, the penetration of the far end spike 220 in concrete will be adequate to support the required load.

An analysis of the rungs 700 was also undertaken. The load imparted by the soldier's foot onto the rung 700 of the bridge 150 is modeled as a point load. This is a conservative assumption because it increases the shear and moment caused by the load.

The analysis of the rungs 700 included testing each rung separately for failure, by attaching each end of the test specimen to a looped cable pinned to the test apparatus. This essentially created a pin-roller support to test for ultimate strength in bending. Increasing incremental loads were added to the rung 700 until a final load exceeding approximately 350 pounds, applied centrally, was verified. Each specimen was tested at a length of 16 inches. This also introduced a factor of safety when the length is shortened to 15 inches.

An iterative code was then generated that took account of the maximum deflection, maximum shear, and bending failure. The code checked these three modes of failure against a set outer diameter of aluminum and returned the thinnest rung thickness that would not fail under these constraints. Each test also output an estimated volume and weight, so that the outer diameter could be adjusted by the programmer to optimize these factors.

The following three equations were used to check the properties of geometry and material strength versus maximum allowable deflection, shear failure, and failure in bending, respectively.

First equation:

$$I_{\delta Allow} = \frac{P * L^3}{48 * E * \delta_{max}}$$

where I is moment of inertia, P is load applied (350 pounds), L is Length of the member (e.g., 15 inches), E is the modulus of elasticity, $\delta_{max}$ is the selected maximum allowable deflection.

Second equation:

$$\tau_{Allow} = \frac{4 * P}{2 * A_{cs}} * \frac{r_{out}^2 + r_{out} * r_{in} + r_{in}^2}{r_{out}^2 + r_{in}^2}$$

where $\tau$ is shear stress, $A_{cs}$ is cross sectional area, $r_{out}$ is the outer radius, and $r_{in}$ is the inner radius.

Third equation:

$$I_{\sigma Allow} = \frac{P}{2} * \frac{L}{2} * \frac{r_{out}}{\sigma_{max}}$$

where $\sigma_{max}$ is the yield stress of the material, which is used to find the maximum load that does not produce permanent deformation.

Figure 13:
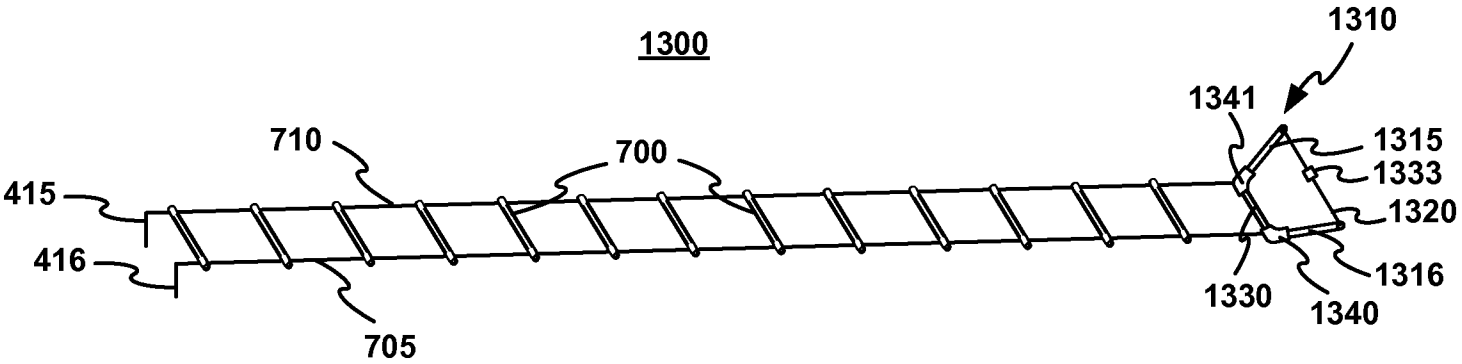
FIG. 13 is a view of the bridge shown provided with a spreader assembly.

FIG. 13 illustrates a bridge 1300 according to another embodiment of the present invention. The bridge 1300 is similar in design and construction to the bridge 150 of FIG. 7, with the exception that the bridge 1300 is provided with a spreader assembly 1310 that limits the twisting of the bridge 1300 along the longitudinal axis. The spreader assembly 1310 generally includes two horizontal spreaders 1315, 1316 that are secured to the forward rung 1330, and that are tensioned by means of a wire or cable 1320.

The spreaders 1315, 1316 are generally similar in design and function and therefore only one spreader 1315 will be described in more detail. The spreader 1315 is preferably made of the same material as the rungs 700, including the forward rung 1330. As an example, the spreader 1315 may be made of an aluminum pipe with the same gauge as that of the rungs 700. The spreader 1315 is secured to one end of the forward rung 1330 by means of a larger gauge elbow 1341 that fits snuggly onto the end of the forward rung 1330. Similarly, the spreader 1316 is secured to the opposite end of the forward rung 1330 by means of an elbow 1340 which is similar in design and construction to the elbow 1341.

Upon assembly, the two spreaders 1315, 1316 branch out into a Y-shaped configuration to provide a wider support area to the bridge 1300, and thus improve its stability against twisting. The tips or forward ends of the two spreaders 1315, 1316 are tensioned and kept in the Y-shaped configuration by means of the wire 1320. In this regard, the wire 1320 spans across the open Y-shaped configuration of the two spreaders 1315, 1316 and is secured in this position by any known or available method. As an example, a clasp 1333 may be added to connect the two end of the wire 1320 between the spreaders 1315, 1316. In addition, the wire 1320 may be run entirely through the rungs 700.

When it is desired to stow the bridge 1300, the ends 1360, 1361 of the wire 1320 are released and the tension on the two spreaders 1315, 1316 is relaxed, allowing them to collapse and to be tucked alongside the rungs 700 in a backpack or another storage container.

It is to be understood that the phraseology and terminology used herein with reference to device, mechanism, system, or element orientation (such as, for example, terms like "front", "back", "up", "down", "top", "bottom", "forward", "rearward", and the like) are only used to simplify the description of the present invention, and do not alone indicate or imply that the mechanism or element referred to must have a particular orientation. In addition, terms such as "first", "second", and "third" are used herein and in the appended claims for purposes of description and are not intended to indicate or imply relative importance or significance.

It is also to be understood that the invention is not limited in its application to the details of construction and the arrangements of components set forth in the following description or illustrated in the drawings. Other modifications may be made to the present design without departing from the spirit and scope of the invention. The present invention is capable of other embodiments and of being practiced or of being carried out in various ways, such as, for example, in military and commercial applications.

What is claimed is:

1. A crossing device to aid in crossing from a near side to a far side of an obstacle, comprising:

a lead assembly that is projected from the near side to the far side of the obstacle;

a bridge;

a cable that connects the lead assembly to the bridge; and a near side anchor assembly;

wherein the lead assembly includes a far side anchor assembly and a pulley; and wherein the far side anchor assembly is anchored on the far side of the obstacle by initiating a propellant charge.

2. The crossing device of claim 1, wherein the anchor assembly includes a spike.

3. The crossing device of claim 2, further including means for up righting the spike when the far side anchor assembly reaches the far side of the obstacle.

4. The crossing device of claim 3, wherein said means for up righting the spike includes a base that causes a center of gravity of the far side anchor assembly to shift toward a bottom of the base.

5. The crossing device of claim 4, wherein the base is made of steel.

6. The crossing device of claim 4, wherein upon initiation of the propellant charge, an explosion force drives the spike downward for anchoring the base.

7. The crossing device of claim 6, wherein the far side anchor assembly further includes a launch tube that houses the spike and that guides the spike while being driven downward by the explosion force.

8. The crossing device of claim 7, wherein the launch tube is made of aluminum.

9. The crossing device of claim 6, further including a remote actuation device for remotely initiating the propellant charge.

10. The crossing device of claim 6, further including a cap that houses the propellant charge.

11. The crossing device of claim 10, further including:

a remote actuation device for remotely initiating the propellant charge; and wherein the cap further houses the remote actuation device.

12. The crossing device of claim 11, wherein the cap is made of light weight material.

13. The crossing device of claim 1, wherein the bridge is collapsible.

14. The crossing device of claim 6, further comprising a pulley tether that connects the pulley to the spike.

15. The crossing device of claim 14, wherein the pulley tether passes through an opening in the base.

16. The crossing device of claim 15, wherein the pulley tether passes through a channel that is formed internally within the launch tube.

* * * * *